United States Patent [19]

Smith, Jr.

[11] 4,429,912

[45] Feb. 7, 1984

[54] FOLDABLE SECURITY BAR

[75] Inventor: Robert P. Smith, Jr., Irving, Tex.

[73] Assignee: Michael Clate Woodlock, Ft. Worth, Tex.

[21] Appl. No.: 280,499

[22] Filed: Jul. 6, 1981

[51] Int. Cl.[3] ..... E05C 17/12

[52] U.S. Cl. ..... 292/263; 292/DIG. 46

[58] Field of Search ..... 292/149, 263, DIG. 46; 403/100, 102

[56] References Cited

U.S. PATENT DOCUMENTS

| | | | |
|---|---|---|---|
| 1,248,932 | 12/1917 | Serafin | 403/100 X |
| 2,133,692 | 10/1938 | Gittings et al. | 403/100 X |
| 3,825,290 | 7/1974 | Messina et al. | 292/263 |

FOREIGN PATENT DOCUMENTS

| | | | |
|---|---|---|---|
| 15638 | 10/1897 | United Kingdom | 292/149 |

*Primary Examiner*—Richard E. Moore

*Attorney, Agent, or Firm*—Dennis T. Griggs

[57] ABSTRACT

A foldable security bar is permanently attached to a sliding panel such as a patio door or window and is operable without interfering with normal use of the panel. The foldable security bar assembly includes first and second bar sections, each section having a tubular open end portion. The bar sections are pivotally connected for movement from a closed position in which the open end portions are in axial alignment to an open position in which the bars extend transversely with respect to each other. A movable latch is slidably received within the tubular open end portion of one bar section for locking and unlocking the assembly. The latch is movable from a fully retracted, released position permitting unobstructed pivotal movement of the bar sections to a locked position in which opposite end portions of the latch extend within both tubular end portions when the bar sections are in axial alignment, thereby preventing pivotal movement of the bar sections. When the latch is in the released position, the panel is freely movable between fully closed and open positions. When the latch is in the locked position, the security bar positively secures the movable panel in the closed position thereby preventing movement of the panel and discouraging unauthorized entry.

1 Claim, 7 Drawing Figures

FOLDABLE SECURITY BAR

BACKGROUND OF THE INVENTION

1. Field of the Invention

This invention relates generally to building security equipment, and more particularly to lock structures for sliding panels such as patio doors and windows.

2. Description of the Prior Art

The most common means for unauthorized entry into a home or dwelling is by forcible entry through a window or sliding glass door. Sliding glass doors and windows are usually equipped with a standard releasable latch which retains the door or window in a locked position. However, most of these locking mechanisms can be broken simply by inserting a pry bar between the movable door or window and the jamb member of the support frame.

Such locking mechanisms have been reinforced by additional locking devices to prevent the sliding door panel or window from being forced open. A commonly used device is an elongated bar or stick which is positioned between the frame of the sliding door or window and the opposing jamb member. The bar serves as a compressive brace member which prevents the sliding door or window from being moved. When it is desired to open the door or window, the bar is simply removed from the frame assembly.

Such arrangements in which the lock bar is placed between the movable panel and frame have proven satisfactory for use in which the slidable door or window opens on the inside wherein the lock bar cannot be reached from the outside. In some sliding glass door arrangements, however, the sliding glass door is of the "outside-open" type in which the door moves along a channel in a support frame which lies exposed on the outside of the dwelling. In such an arrangement, a simple one-piece stick or bar cannot be used to secure the door since the stick or bar can be easily removed from the outside by unauthorized persons.

OBJECTS OF THE INVENTION

Therefore, it is the general object of the invention to provide an improved lock bar which can be used in combination with windows or sliding glass doors of both the inside-open and outside-open types.

Another object of the invention is to provide an improved locking mechanism for securing a movable panel against forceable opening.

A particular object of the invention is to provide a foldable, compressive brace mechanism which positively secures a movable panel such as a sliding glass door or window to a fixed, closed position within a support frame.

A related object of the invention is to provide a permanently attached locking device for a sliding panel such as a patio door or window which does not interfere with normal use of the panel, in which the panel is movable between fully closed and open positions, but which restricts unauthorized entry in the closed, locked position.

SUMMARY OF THE INVENTION

The foregoing objects are provided by a foldable security bar which is permanently attached to a sliding panel such as a patio door or window or which is operable without interfering with normal use of the door or window.

The foldable security bar assembly includes first and second bar sections, each section having tubular open end portion. The bar sections are pivotally connected for movement from a closed position in which the open end portions are in axial alignment to an open position in which the bars extend transversely with respect to each other. A movable latch is slidably received within the tubular open end portion of one bar section for locking and unlocking the assembly. The latch is movable from a fully retracted, released position permitting unobstructed pivotal movement of the bar sections to a locked position in which opposite end portions of the latch extend within both tubular end portions when the bar sections are in axial alignment, thereby preventing pivotal movement of the bar sections. When the latch is in the released position, the door or window is freely movable between fully closed and open positions. When the latch is in the locked position, the security bar defines a compressive brace which positively secures the movable panel in the closed position, thereby preventing movement of the panel and discouraging unauthorized entry.

End brackets are pivotally coupled to the first and second bars for mounting the assembly between the movable panel and a support frame. According to this arrangement, the lock bar assembly can be used in combination with windows or sliding glass doors of both the inside-open and outside-open types.

In a preferred embodiment, the latch is an elongated plunger which is axially movable through the tubular open end portions. One of the tubular portions is provided with an elongated slot, and the plunger is provided with a threaded bore for receiving a threaded fastener. The threaded fastener is movable into and out of engagement with the sidewall for manually locking and unlocking the plunger.

The novel features which characterize the invention are defined by the appended claims. The foregoing and other objects, advantages, and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENT

Figure 1:
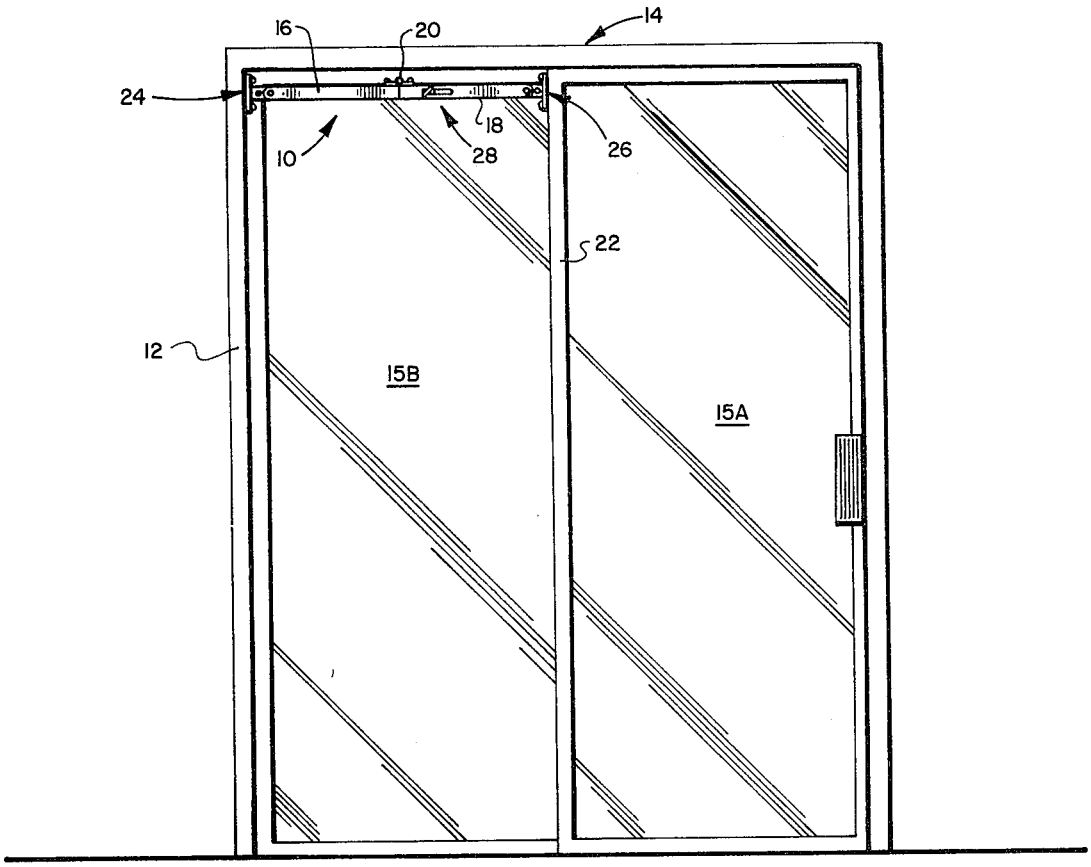
FIG. 1 is an elevation view of a foldable security bar as installed in combination with an inside-open patio door.

In the description which follows, like parts are marked throughout the specification and drawing with the same reference numerals, respectively. The drawings are not necessarily to scale and in some instances portions have been exaggerated in order to more clearly depict certain features of the invention.

The security bar of the invention is described in combination with a sliding patio door. It will be understood, however, that the foldable security bar of the invention may be used to good advantage in combination with other slidable panels such as a window or the like.

Referring now to FIG. 1, a foldable security bar assembly 10 is mounted between the upper end of a vertical frame member 12 of a sliding patio door assembly 14 having a glass panel 15A and a fixed glass panel 15B in an inside-open arrangement. The foldable security bar 10 includes a first bar section 16 and a second bar section 18. The fist and second bar sections are pivotally connected together by a hinge 20. The opposite ends of the bar sections are permanently connected to the support frame 12 and to a panel frame 22 by bracket assemblies 24, 26.

Figure 2:
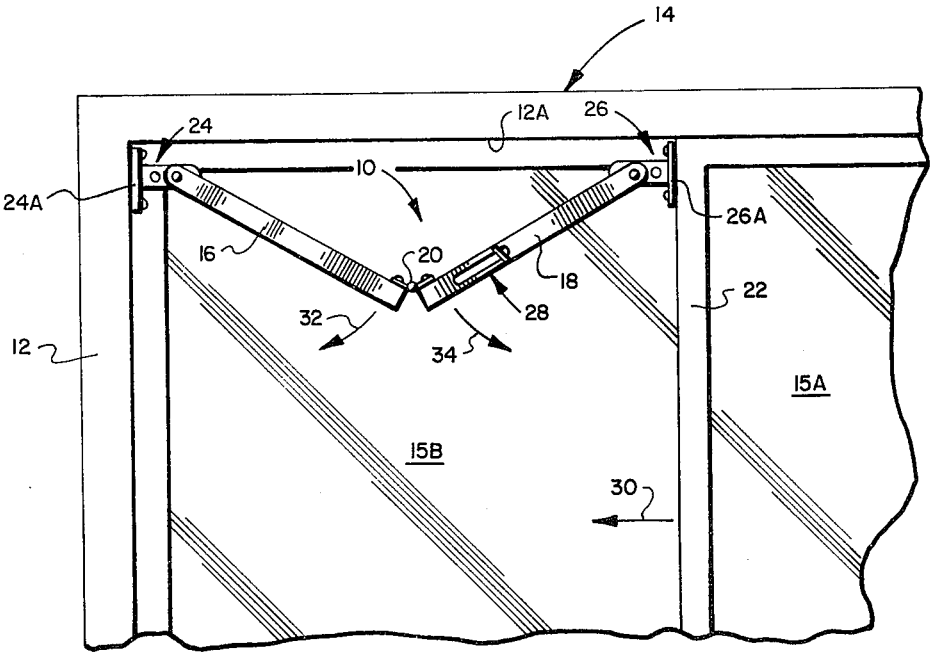
FIG. 2 is a partial elevation view corresponding with FIG. 1 which illustates the folding action of the security bar as the door is opened.

The foldable security bar 10 is shown in its locked position in FIG. 1. The security bar 10 is provided with a latch assembly 28 which is movable to a closed position as shown in FIG. 1 for locking the bar sections together to prevent opening movement of the sliding patio door 15A, to an open position as shown in FIG. 2, which allows the bar sections to pivot about the hinge 20 as the patio door is opened as indicated by the arrow 30. In response to opening movement of the patio door 15A, the bar sections 16, 18 rotate about the hinge 20 in the directions as indicated by the arrows 32, 34 respectively.

Figure 3:
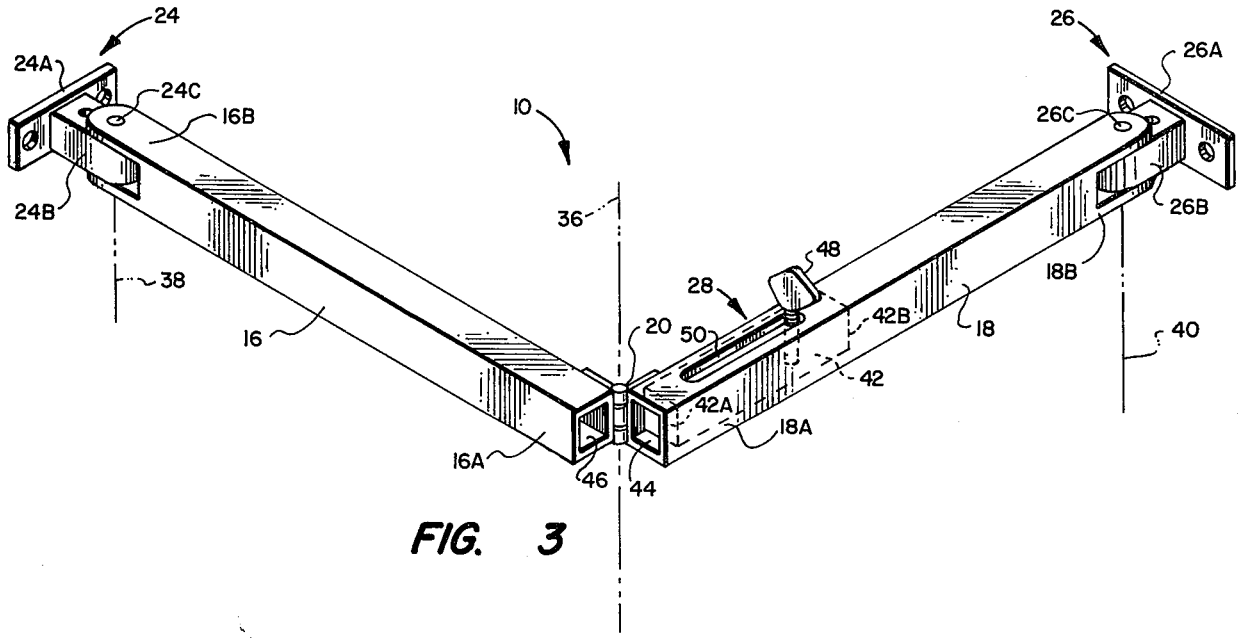
FIG. 3 is a perspective view of the security bar of FIG. 1 in the open position.
Figure 4:
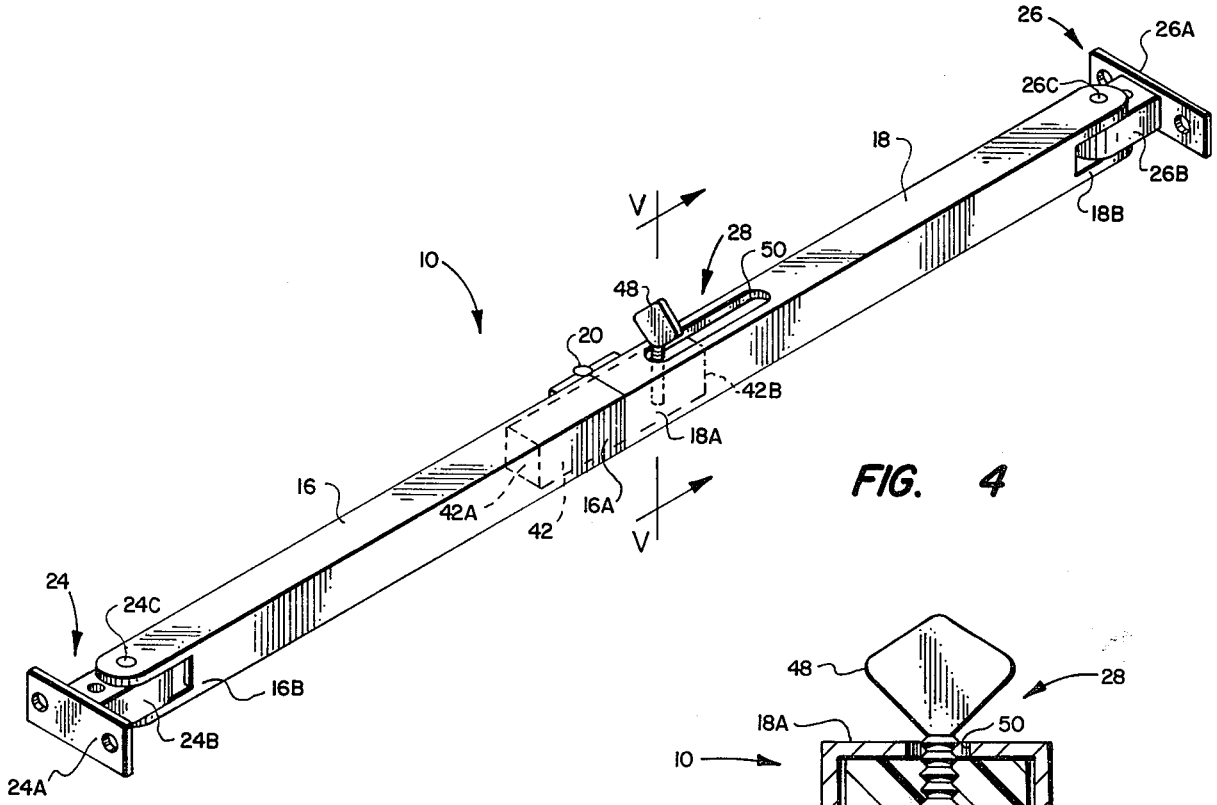
FIG. 4 is a perspective view of the security bar of FIG. 1 in the closed position.
Figure 5:
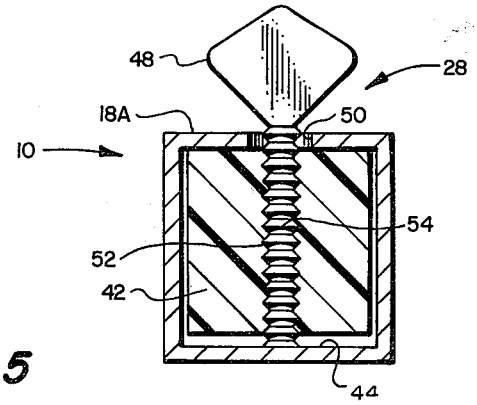
FIG. 5 is a section view of the security bar taken along the lines V—V of FIG. 4.

Referring now to FIGS. 3, 4 and 5, the bar sections 16, 18 are preferably constructed of light-weight, high strength extruded aluminum tubing having a rectangular cross-section. Each bar section 16, 18 is provided with a tubular open end portion 16A, 18A, respectively. The bar sections 16, 18 are rotatable about a common axis 36 from an open position in which the bar sections extend transversely with respect to each other as shown in FIGS. 2 and 3, to a closed position in which the tubular open end portions 16A, 18A are in axial alignment with each other as shown in FIGS. 1, 4.

The bracket assemblies 24, 26 each include a mounting plate 24A, 26A, respectively, for permanently mounting the security bar assembly 10 to the frame member 12 and the panel frame 22. The mounting plates 24A, 26A are pivotally coupled to the bar section 16, 18 respectively by rods 24B, 26B which are movably coupled thereto by pins 24C, 26C received within clevis portions 16B, 18B, respectively. The clevis end portions 16B, 18B each define a yoke in which the rod coupling members 24B, 26B are freely rotatable. According to this arrangement, bar section 16 rotates about a fixed axis 38 and about the movable axis 36, while the second bar section 18 rotates about the movable axis 36 and an axis 40 which is fixed in elevation.

The construction details of the latch assembly 28 can best be seen in FIG. 5. The latch assembly 28 includes an elongated plunger 42 which is slidably received within the tubular open end portion 18A. The plunger 42 is rectangular in cross-section and is preferably constructed of a light-weight, durable material such as Nylon. The plunger 42 is received within the pocket or cavity 44 enclosed by the tubular sidewall 18A. The tubular sidewall 16A likewise encloses a pocket or cavity 46. The plunger 42 is movable from a released position (FIG. 3) in which it is fully retracted within the tubular open end portion 18A of the bar section 18, thereby permitting unobstructed pivotal movement of the bar sections relative to each other, and movable to a locked position in which opposite end portions 42A, 42B of the plunger are received within both pockets 44 and 46 when the tubular open end portions 16A, 18A are in axial alignment (FIG. 4), thereby preventing pivotal movement of the bar sections.

The plunger 42 is manually locked and released by a thumb screw fastener 48 which is movable into and out of engagement with the sidewall 18A for locking and unlocking the plunger 42. One face of the sidewall 18A is intersected by an elongated slot 50 which permits the thumb screw 48 to travel freely as the plunger 42 is moved between the released and locked positions. The plunger 42 is provided with a threaded bore 52 which is aligned with the slot 50, and in which a threaded shank portion 54 is received. The plunger 42 is locked in place simply by turning the thumb screw 48 until the plunger is driven into engagement with the slotted sidewall 18A.

Figure 6:
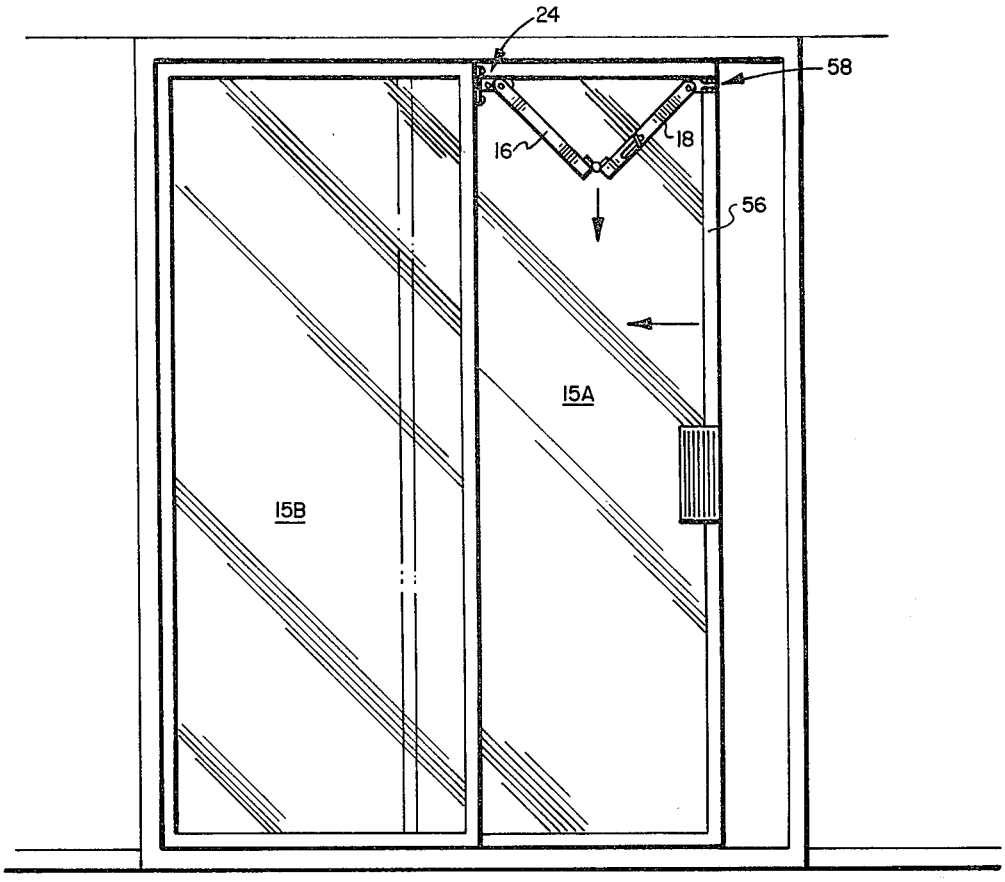
FIG. 6 is a view similar to FIG. 1 which illustrates the installation of the security bar in an outside-open sliding door arrangement; and, FIG. 7 is a perspective view of a mounting bracket portion used in the outside-open sliding door arrangement.
Figure 7:
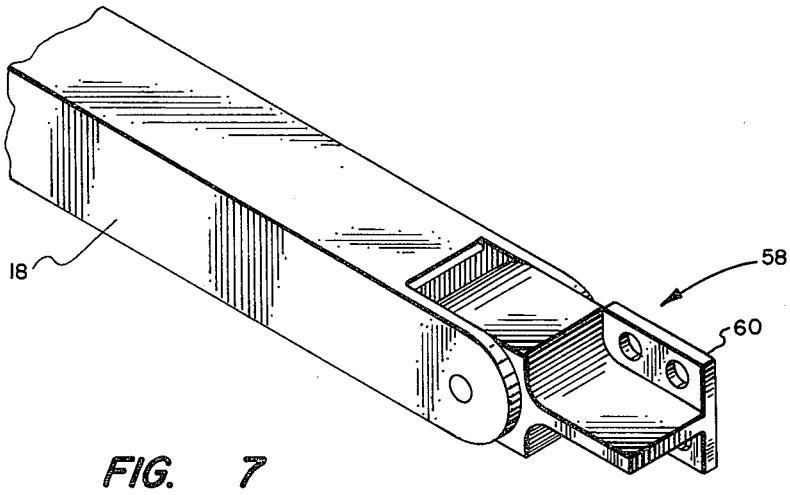

Installation of the foldable security bar 10 in an outside-open patio door arrangement is illustrated in FIGS. 6 and 7. In this arrangement, the movable door 15A travels along an exterior channel track. The bracket assembly 58 has a slightly different surface configuration for engaging the side of the panel frame 56. The bracket assembly 58 includes a plate portion 60 which engages the side surface of the panel frame 56 for efficiently reacting compression forces when the assembly is in the locked position.

The foldable security bar assembly 10 is preferably mounted closely adjacent to the underside 12A of the door frame 12. In this arrangement, the mounting plates 24A, 26A act as stop members which prevent unauthorized removal by preventing the sliding glass panels 15A and 15B from being lifted vertically out of the slide tracks.

Although preferred embodiments of the invention have been described in detail, it should be understood that various changes, substitution and alterations can be made therein without departing from the spirit and scope of the invention as defined by the appended claims.

What is claimed is:

1. In a slidable panel assembly in which a panel is movable along parallel channel members between open and closed positions within a support frame and in which the movable panel can be removed from the assembly by transverse displacement of the panel out of engagement with one channel member, the improvement comprising a foldable security bar assembly for securing the movable panel against said support frame, said foldable security bar assembly including first and second bars each having a tubular open end portion; a hinge pivotally connecting said first bar to said second bar whereby said first and second bars are rotatable about a common axis from a closed panel position, in which their tubular open end portions are in axial alignment, to an open panel position in which said bars extend transversely with respect to each other; a latch slidably received within the tubular open end portion of the first bar and movable from a released position in which said latch is fully retracted within the open end portion of said first bar thereby permitting unobstructed pivotal movement of said first bar and said second bar relative to each other, and movable to a locked position in which opposite end portions of said latch extend within both tubular open end portions of said first and second bars when said tubular open end portions are in axial alignment, thereby preventing pivotal movement of said first bar and said second bar; and, bracket means pivotally coupled to said first and second bars and mounting said first and second bars to the movable panel and support frame, respectively, said bracket means including a mounting plate attached to said movable panel in a position closely adjacent said support frame but spaced from said frame allowing sliding movement of said panel along said channel members without interference, but engaging said support frame and thereby serving as a stop member in response to transverse displacement of the movable panel within said channel members.

* * * * *